US006048215A

United States Patent [19]

Tateishi

[11] Patent Number: 6,048,215

[45] Date of Patent: Apr. 11, 2000

[54] PLUG LOCK FOR ELECTRICAL APPLIANCES

[76] Inventor: Art Tateishi, 25 Warrender Avenue, Apt. #202, Islington, Ontario, Canada, M9B 5Z4

[21] Appl. No.: 09/075,401

[22] Filed: May 11, 1998

[51] Int. Cl.[7] ..... H01R 4/66; H01R 13/44; H01R 13/62

[52] U.S. Cl. ..... 439/102; 439/139; 439/373

[58] Field of Search ..... 439/102, 346, 439/929, 501, 535, 139, 137, 373; 248/227.1, 264, 268, 304, 318, 322, 127, 535, 477, 674

[56] References Cited

U.S. PATENT DOCUMENTS 4,105,274 8/1978 Casey ..... 339/75 P
4,711,419 12/1987 Polosky ..... 248/225
5,086,916 2/1992 Gray ..... 206/209.1
5,267,870 12/1993 Maresh ..... 439/139
5,488,537 1/1996 Heald et al. ..... 361/684
5,722,208 3/1998 Humphrey et al. ..... 52/220.8

*Primary Examiner*—Paula Bradley
*Assistant Examiner*—Edwin A. Leon

[57] ABSTRACT

An electrically operated heater fan is suspended by a bracket from a building wall using a bracket mount having a plug lock which is releasably lockable within one of a pair of plug receptacles of a standard wall outlet with the plug of the heater fan fitting into the other plug receptacle. The plug lock of the bracket mount comprises a pair of electrically insulated flat slot fitting prongs and an electrically insulated ground opening fitting post which is adjustable between a receptacle insertion position and a receptacle locked in position by a control member rotatable on the bracket mount.

16 Claims, 6 Drawing Sheets

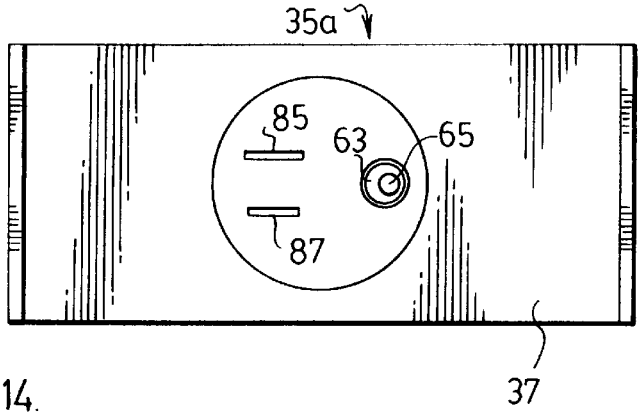
FIG. 14.
FIG.15.
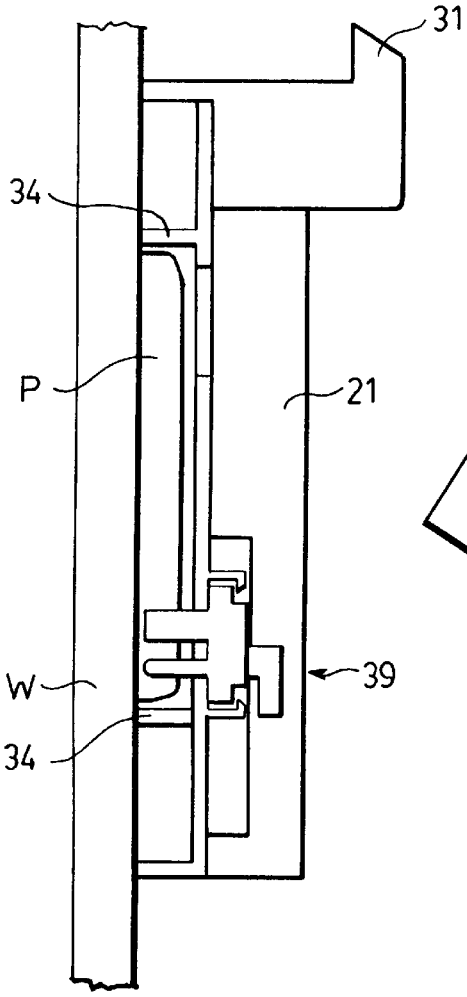
FIG.16.
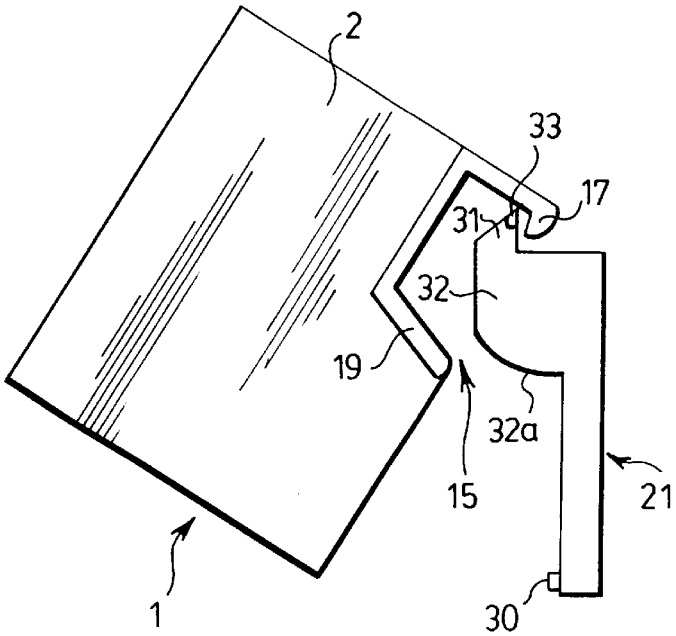

PLUG LOCK FOR ELECTRICAL APPLIANCES

FIELD OF THE INVENTION

The present invention relates in general to the locking of an electrical plug in an electrical receptacle and has particular application for wall suspended electrical appliances.

BACKGROUND OF THE INVENTION

Electrical heater fans have become more and more popular over time. One of the reasons for their popularity is that rather than being dedicated to a specific location they can be moved from room to room.

In recent years electrical heater fans have been made such that they can plug directly into and be suspended from an electrical outlet on a wall. This eliminates the requirement for floor space for the heater fan and also raises the heater fan to a position where the flow of heater air from the fan is off of the floor.

To date, wall mounted heater fans include a relatively standard electric plug which is supported on the back surface or casing of the heater fan. The heater fan is then simply pushed by its plug into the electrical outlet where its plug holds it suspended from the wall. However, because there is no interlock, other than the standard fit between the plug and the receptacle, the plug on the heater fan is not capable of supporting a substantial load. Therefore, the known wall mounted heater fans are relatively light in weight having a maximum operating capacity of 1200 watts. A ground supported heater fan on the other hand typically has a maximum operating capacity of 1500 watts and is therefore, capable of producing more heat than the wall mounted heater fan.

SUMMARY OF THE INVENTION

The present invention relates to a locking member which is releasably lockable within a standard wall fitted electrical receptacle and can for example be used in a suspension system for a wall mounted electrical appliance such as a heater fan or the like.

The locking member itself has an insulated body portion presenting first and second slot fitting prongs and a ground opening fitting post arranged in a triangular pattern with the prongs so that the locking member fits into a standard electrical receptacle. The post of the locking member is adjustable between a receptacle insertion position and a receptacle locked in position by a control member rotatably supported by the insulated body portion of the locking member.

The locking member can be used in association with a mounting bracket for an electrical appliance such as a heater fan and is capable of supporting a substantial load such that the heater fan can be of a size to operate at up to 1500 watts of power.

BRIEF DESCRIPTION OF THE DRAWINGS

The above as well as other advantages and features of the present invention will be described in greater detail according to the preferred embodiments of the present invention in which:

FIG. 14 is a bottom view of the bracket mount of FIG. 3*a;*

FIG. 15 is a sectional view of the bracket and bracket mount of FIG. 3 when locked at the electrical receptacle;

FIG. 16 is a sectional view through the heater fan as it is being fitted to the bracket of FIG. 3.

DETAILED DESCRIPTION OF THE PREFERRED EMBODIMENTS

Figure 1:
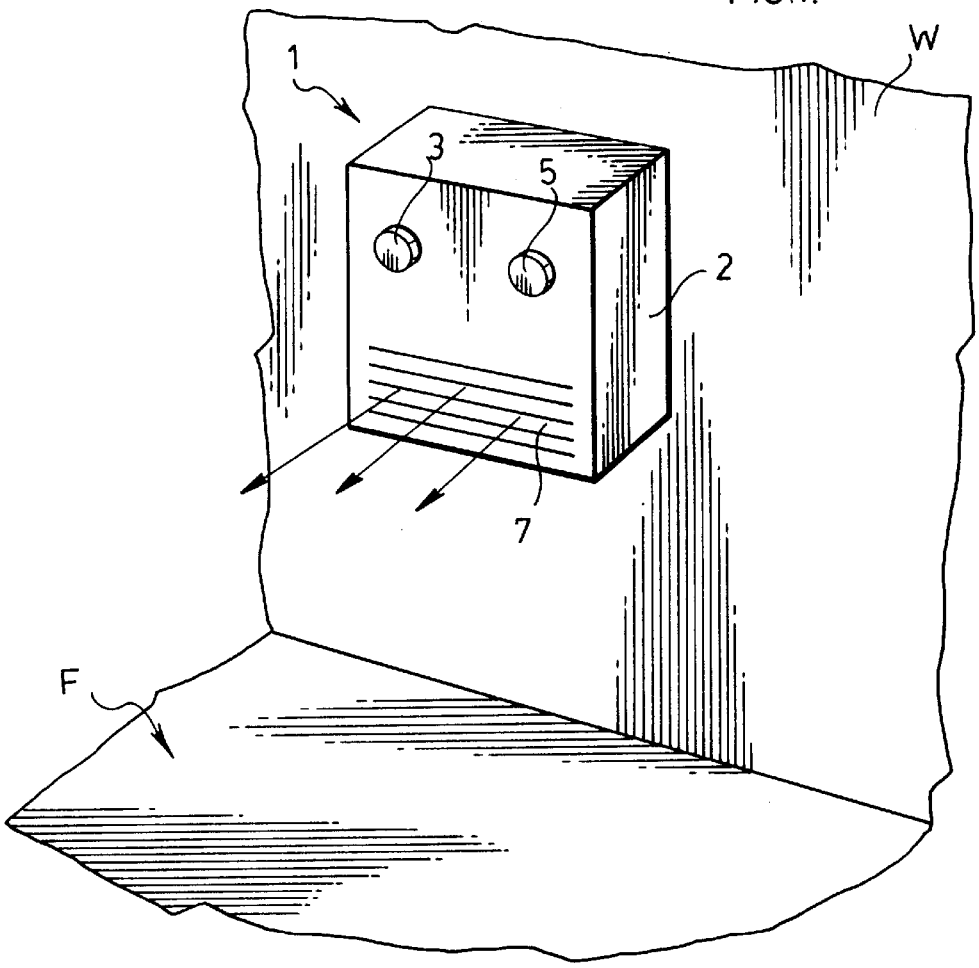
FIG. 1 is a perspective view of a heater fan suspended from a wall by a mounting assembly behind the heater fan according to a preferred embodiment of the present invention.
Figure 3:
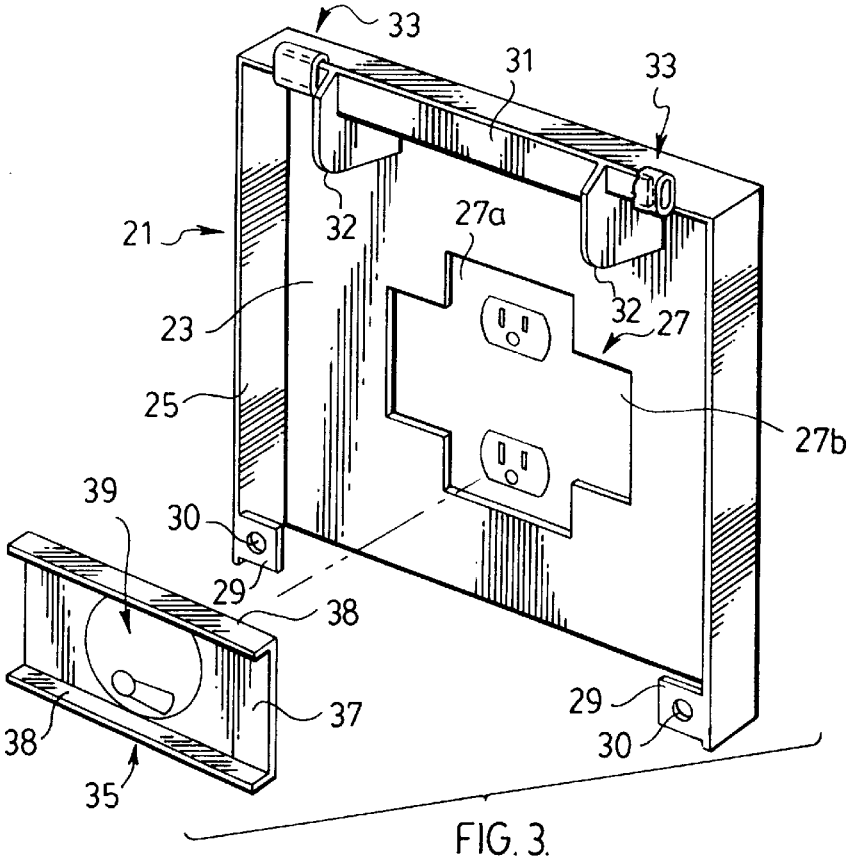
FIG. 3 is an enlarged exploded perspective view showing the bracket mount over the electrical outlet and the bracket mount for the bracket used to suspend the heater fan of FIG. 1.

FIG. 1 shows a heater fan generally indicated at 1 supported on a building wall W above the floor F. The wall W is fitted with a standard electrical outlet which has a pair of plug receptacles. Such an outlet is shown in FIG. 3 of the drawings, located behind a mounting bracket generally indicated at 21 for supporting the heater fan and suspending it from the wall.

The heater fan itself comprises a casing 2 which is preferably made from plastic. This casing encloses the known fan and heater elements which are operated by manual controls 3 and 5 on the front of the casing. Also provided on the front of the casing is a grill 7 through which air is blown from the heater fan. Again, as is known in the art, this air can either be room temperature or heated air, depending upon whether the heater part of the fan is being operated.

Figure 2:
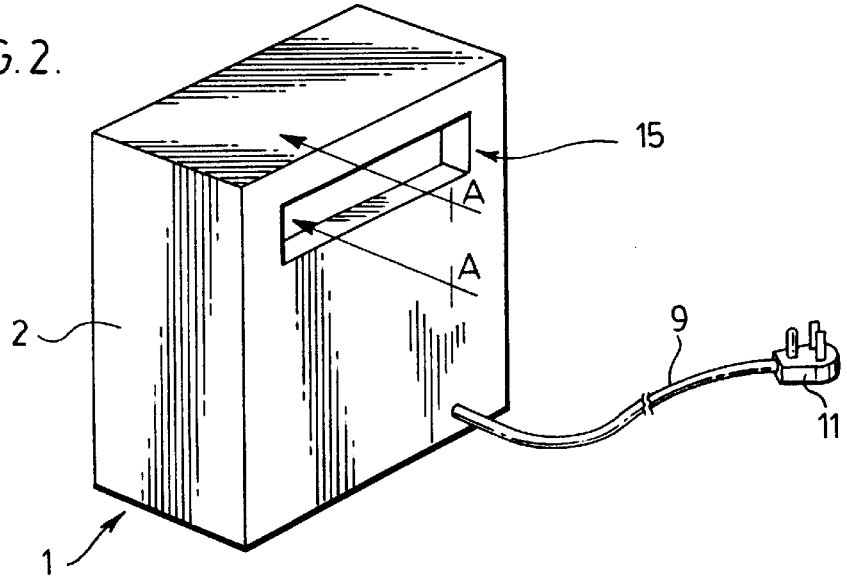
FIG. 2 is a rear perspective view of the heater fan of FIG. 1.

FIG. 2 shows that the rear of the heater fan is provided with an electrical cord 9, terminating with a plug 11. Electrical cord 9 is substantially shorter than a conventional appliance cord and plug 11 is a relatively low, flat profile plug providing advantages for reasons which will be described later in detail.

Also provided to the rear of the casing is a recess generally indicated at 15. This recess can be used as a handle for picking up and holding the heater fan and is additionally used as a receiving recess for the mounting bracket for the heater fan. To this end, recess 15 is provided with a downwardly depending hook portion 17 and a lower sloped surface 19.

Mounting bracket 21 as shown in FIG. 3, which is again preferably made from a lightweight strong plastic, has a main wall 23 provided with a cross-shaped opening 27. This opening has a vertical part 27*a* and a horizontal part 27*b*.

In the set up shown in FIG. 3 of the drawings, the cover plate over the electrical outlet extends in the vertical direction and the two plug receptacles in the cover plate are exposed through the vertical portion 27*a* of opening 27.

If the cover plate over the electrical outlet extends in the horizontal position, then the two plug receptacles will be exposed through the horizontal portion 27*b* of opening 27.

The main wall 23 of bracket 21 is bordered by a raised edge 25. A pair of stops 29 are provided near the bottom of the bracket. Bumpers 30 which are preferably made from rubber, are provided on stops 29.

The upper end of the mounting bracket is provided with an appliance hanger comprising an upwardly projecting hook like portion 31 and a pair of webs 32, each of which has a radiused undersurface 32*a*. Hook portion 31 and webs 32 fit into the recess 15 on the back of the heater fan as will be described later in detail.

Provided on the outer ends of the hook like portion 31 are a pair of again, preferably rubber sleeves 33, which cooperate with bumpers 30 to act as dampeners between the bracket and the heater fan to essentially eliminate vibration noises during operation of the heater fan.

Bracket 21 is sized such that it is completely covered by and hidden behind the heater fan. When the heater fan and bracket are fully interlocked with one another, they appear to be a single one piece unit. The electrical cord of the heater fan, along with its plug, are hidden in the space between the bracket and the heater fan which is created by the raised wall 25 which provides a standoff between the main wall 23 of the bracket and the back of the heater fan. As earlier noted, the cord on the heater fan is short, i.e., it only needs to be long enough to fit through the bracket into the electrical outlet while the heater fan is off the bracket and does not have to be long enough to allow the heater fan to reach the floor. Also the flat profiling of the plug allows it to easily fit into the storage gap between the bracket and the heater fan.

The bracket mount such as bracket mount 35, shown in FIG. 3 of the drawings, is a very important feature of the present invention. This bracket mount includes a main plate portion 37 which carries a plug lock generally indicated at 39. The plates 37 of the bracket mount includes raised walls 38 to either side of the plug lock. The walls provide grips for holding the bracket mount and for pushing it into and pulling it from the wall receptacle. They also act as stops for holding the plug lock with the mounting bracket as will be described later in detail.

Figure 5:
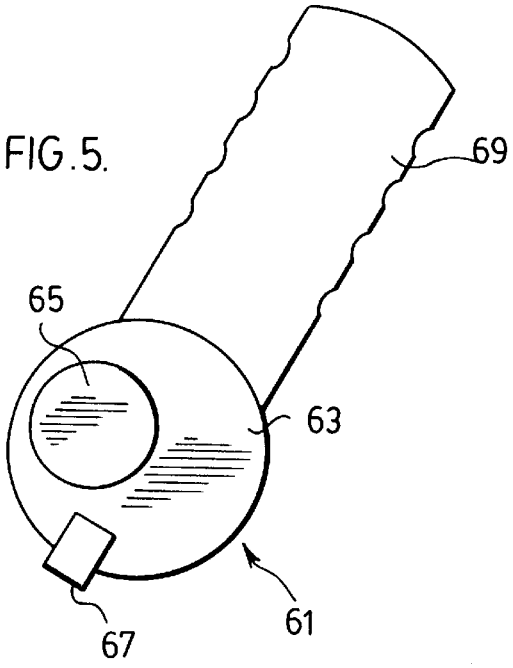
FIG. 5 is a bottom view of the operating part of the plug lock from the bracket mount of FIG. 3.
Figure 6:
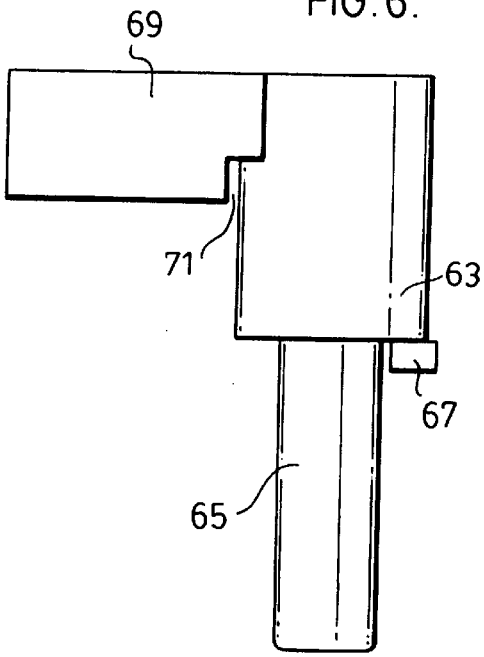
FIG. 6 is a side view of the part shown in FIG. 5.
Figure 7:
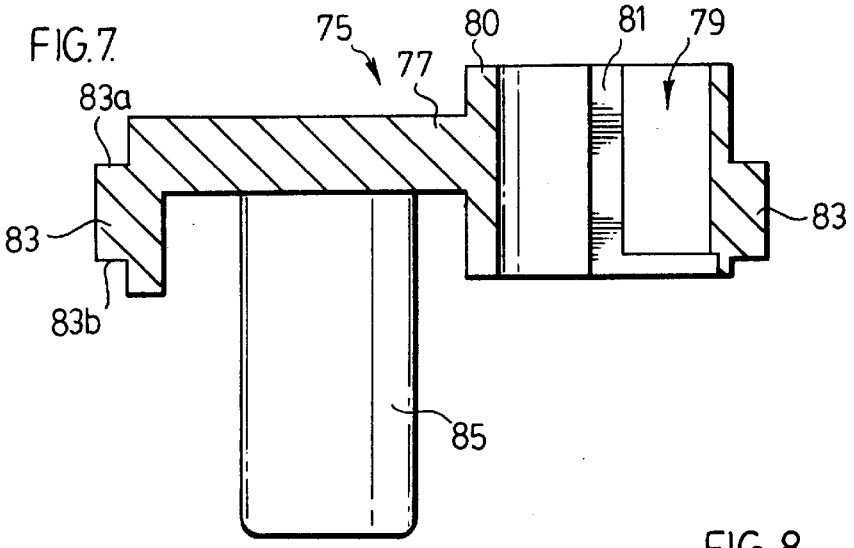
FIG. 7 is a sectional view through the housing used to receive the operating part of FIGS. 5 and 6.
Figure 8:
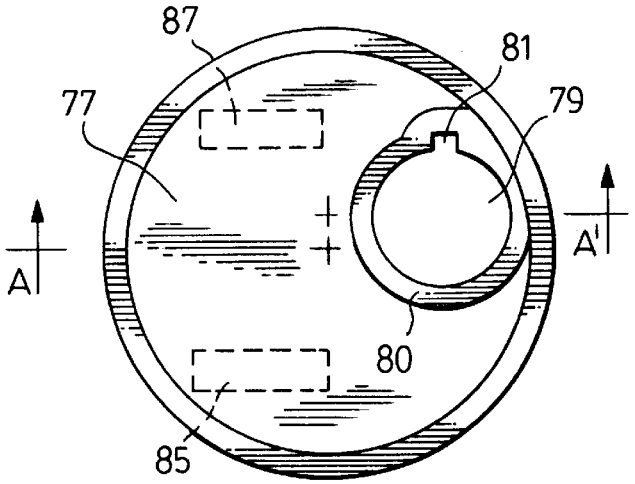
FIG. 8 is a top view of the housing shown in FIG. 7.
Figure 9:
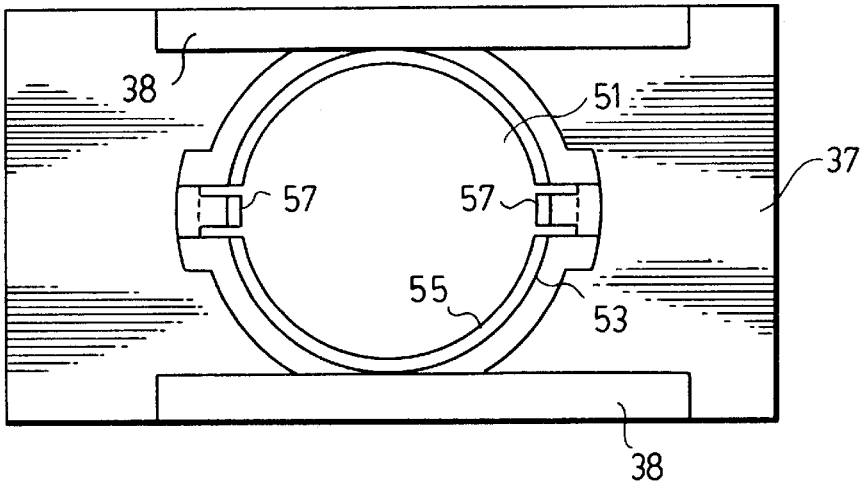
FIG. 9 is a top view of the main plate of the bracket mount of FIG. 3 without the plug lock in position.

The plug lock itself is formed from an operating component generally indicated at 61 in FIGS. 5 and 6 of the drawings, and a housing generally indicated at 75 in FIGS. 7 and 8 of the drawings. The operating component 61 fits within the housing 75, and housing 75 in turn, fits within the main body portion 37 of the bracket mount.

Operating component 61 is formed from a cylindrical body portion 63 having an elongated cylindrical post 65 depending from the bottom surface of body portion 63. As is well shown in FIG. 5, post 65 is mounted off center of body portion 63.

A lever 69 is provided on the top surface of body portion 63 while a small rectangular tooth 67 extends from the side of the body portion, diametrically opposite lever 69.

As can be seen in FIG. 6 of the drawings, a small gap 71 is provided between the bottom side of lever 69 and the side wall of body portion 63.

The housing 75 for receiving operating member 61 comprises a main circular body portion 77 provided with a circular neck 80 with an opening 79 provided through the neck. A small rectangular notch 81 is provided along the side wall of neck 80.

Depending downwardly from the main body 77 of housing 75 are a pair of flat prongs 85 and 87. Prong 85 is slightly longer and wider than prong 87 to fit with corresponding prong openings in most up-to-date plug receptacles.

As shown in FIG. 8, opening 79 is not centered with respect to the two prongs, but rather is slightly offset towards the smaller prong 87.

A side wall extension 83 is provided around the main body of housing 75. This side wall extension presents upper and lower shoulders 83*a* and 83*b*, respectively.

Operating member 61 and housing 75 are preferably made from polyester with a 30% glass filler. This combination of elements makes the plug lock flame retardant and makes it extremely strong.

The plates 37 of the bracket mount, again preferably having a plastic construction, includes a central circular opening 51. This opening is defined by an upper side wall 53 and a lower smaller diameter side wall 55. A pair of flexible barbs 57 are located to either side of opening 51.

In the first step of putting the bracket mount together, operating member 61 is fitted into housing 75. The tooth 67 of the operating member is aligned with notch 81 of the housing allowing the main cylindrical portion 63 carrying post 65 of the operating member to be sleeved into the opening defined by circular wall 80 of the housing. This wall provides a bearing for rotating the operating member. The operating member drops down sufficiently far, such that tooth 67 completely clears through wall 80 which rides up into the opening 71 between the lever 69 and the cylindrical body portion 63 of the operating member. As soon as the operating member is rotated such that tooth 67 of the operating member is out of alignment with notch 81 on the housing, the operating member and the housing are rotatably coupled with one another. The fitting of the plug lock 39 which comprises operating member 61 and housing 75 with the plate 37 of the bracket mount prevents the operating member from rotating back to a position where it can come out of its housing, there by maintaining the rotatable interlock between the operating member and the housing. This will be described later in further detail.

Figure 10:
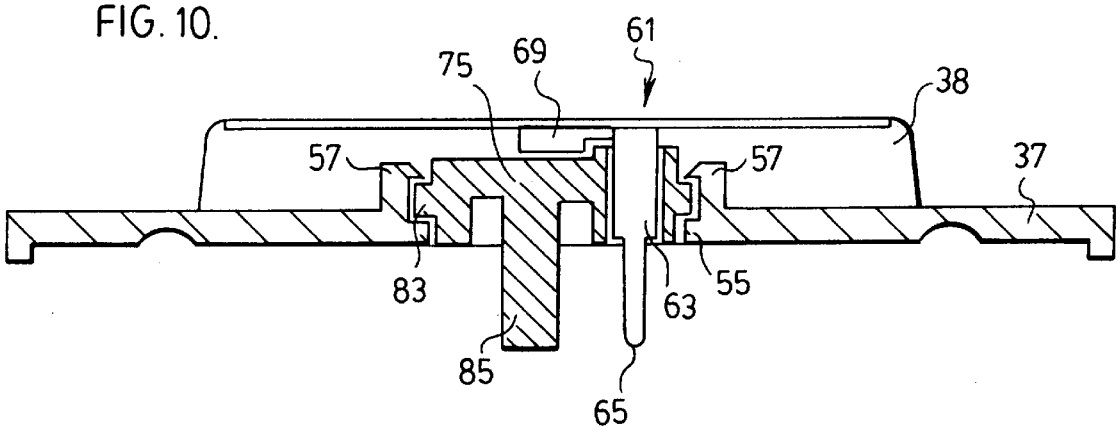
FIG. 10 is a sectional view of the plate of FIG. 9 when fitted with the plug lock.
Figure 11:
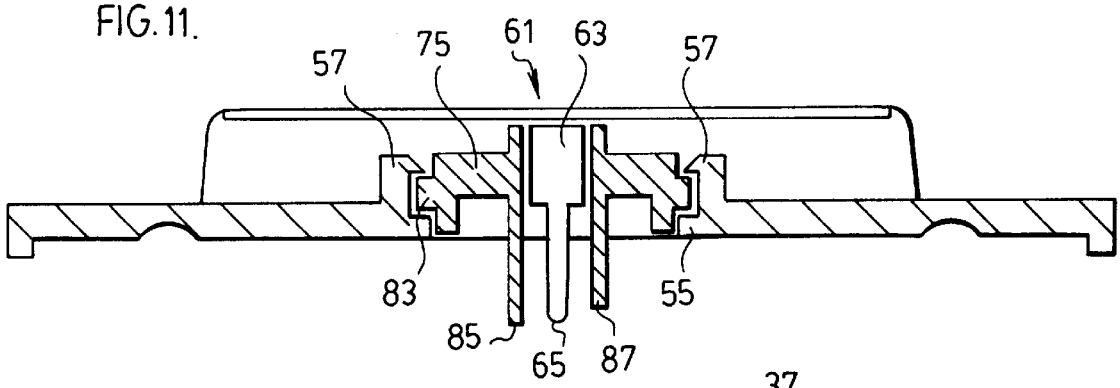
FIG. 11 is a sectional view of the bracket mount similar to FIG. 10 but showing the plug lock in a different operating position.

Once the operating member and housing have been assembled as described above, they are pushed as a single unit into the opening 51 in the plate 37 of the bracket mount. FIGS. 10 and 11 show that the orientation of the plug lock can be varied relative to the orientation of the plate of the bracket mount.

Regardless of the orientation, the housing 75 of the plug lock is cammed through the flexible barbs 57 to either side of opening 51 with these barbs locking on the upper shoulders of the protruding side wall 83 on housing 75. The lower shoulders of protruding side wall 83 sits against the inner wall 55 around opening 51 in the bracket mount plate 37. The housing of the plug lock is now effectively trapped with the bracket mount.

Post 65 extends to one side of the bracket mount in a triangular pattern with the two prongs 85 and 87 while the operating lever 69 for the plug lock is located to the other side of plate 37 and swingable within the raised walls 38 of plate 37. When the plug lock is inserted in plate 37, sidewalls 38 stop the lever from swinging and cylindrical portion 63 from rotating far enough to allow tooth 67 to line up with notch 80 and therefore prevent the operating member from pulling out of the plate.

The swinging of the lever produces rotation of the cylindrical body portion 63 of the plug lock and this in turn produces an oscillating or orbiting motion of the post relative to the circular housing portion 77 on the plug lock. This orbiting motion occurs because of the off-centering position of the post, relative to the cylindrical body portion of the operating member.

As a result of the orbiting motion of the post on the plug lock, it is adjustable between a plug receptacle insertion position and a plug receptacle locked in position. This is well demonstrated in comparing FIGS. 12 and 13 of the drawings.

Figure 12:
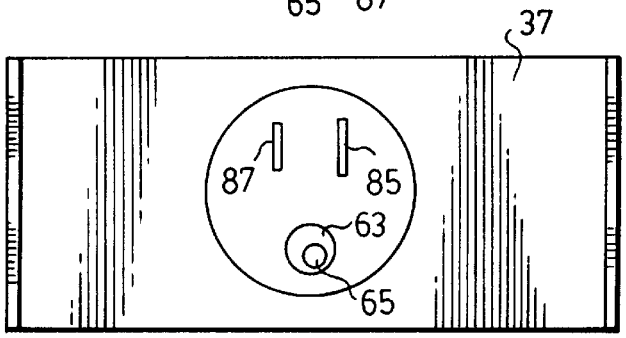
FIG. 12 is a bottom view of the bracket mount of FIG. 3 in the receptacle insertion position.
Figure 13:
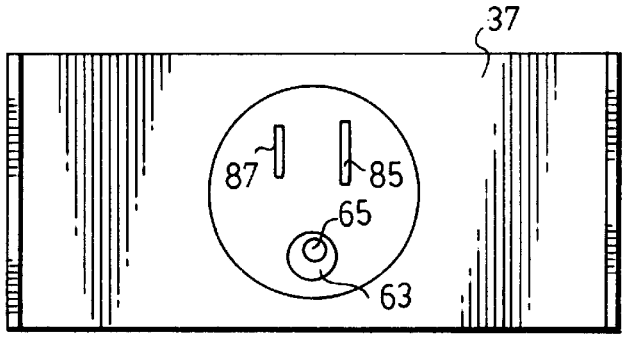
FIG. 13 is a further bottom view of the bracket mount of FIG. 3 with the plug lock in the receptacle locked in position.

More particularly, FIG. 12 shows that the cylinder 63 of the operating member is in a position such that post 65 is aligned in a position centrally offset from the two prongs 85 and 87. FIG. 13 shows that the cylinder 63 has been rotated about 90° from position, causing post 65 to orbit such that it is moved away from the FIG. 12 position to a position more directly beneath and closer to prong 85.

The positioning of the two prongs and the posts in FIG. 12 is the same as the positioning as the prong slots and ground opening in a standard plug receptacle which allows the plug lock to be easily pushed in the FIG. 12 position into the plug receptacle. Once the plug lock is fitted into the receptacle, the operating member of the plug lock is turned by its lever 69 which provides substantial leverage to produce the orbiting of the post. When the post is adjusted to the FIG. 13 position, the post wedges against the face plate over the receptacle as the separation between the post and the prongs and in particular, prong 85 is decreased with the orbiting of the post. This causes both the post and the prongs to clamp onto the face plate.

The orbiting motion of the post to the clamped or interlocked position is enhanced by the off center location of the bearing wall 80 for cylindrical portion 63 relative to prongs 85 and 87. This off center location enables the post to more easily move within the ground opening to the locking position.

Figure 4:
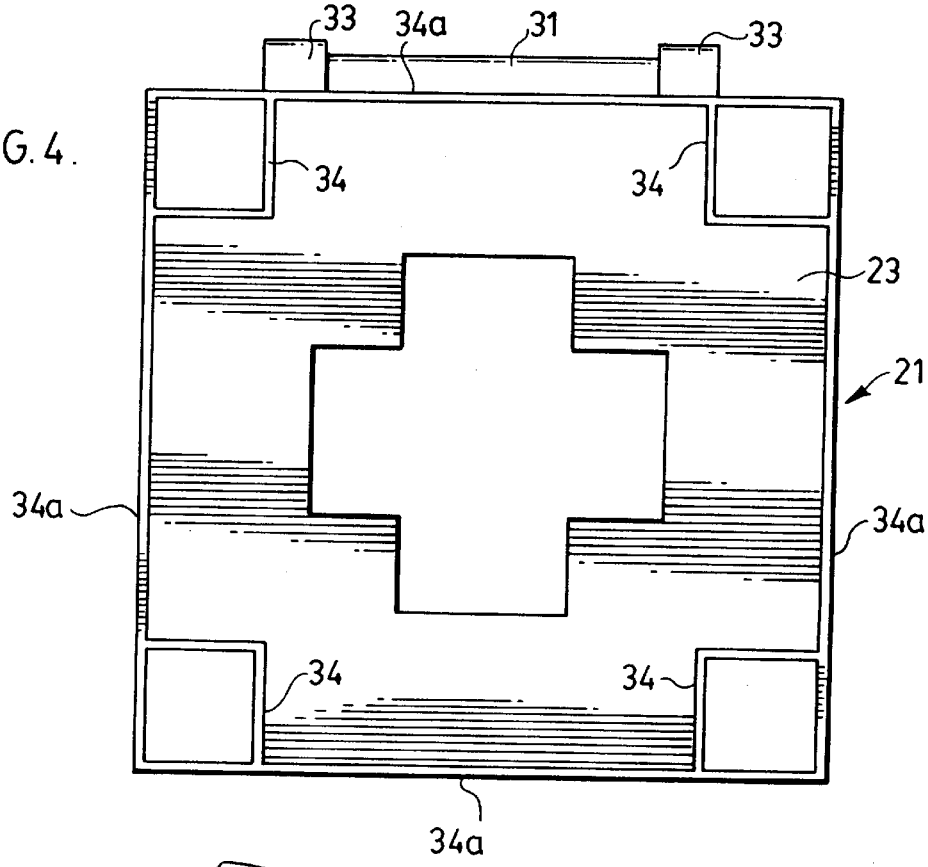
FIG. 4 is a rear view of the bracket of FIGS. 3 and 3*a;*

The initial step in suspending the heater fan is to first mount bracket 21 at the electrical outlet, and more particularly, with the face plate of the electrical outlet. Here it should be noted from FIG. 4 of the drawings that bracket 21 on its front side, i.e., the side that faces the wall, has four corner members 34 and a wall 34*a* level with these four corner members. The main wall 23 of the bracket is recessed relative to corner member 34 and wall 34*a*. Therefore, when the bracket is fitted over the face plate on the wall, the face plate in fact fits into the bracket with the four corner members 34 of the bracket locking onto the sides of the face plate and the wall 34*a* of the bracket locking onto the ends of the face plate. This happens regardless of the direction of the face plate, i.e., whether the face plate is set in the vertical orientation of FIG. 3 or at 90° to the FIG. 3 orientation where the face plate sits horizontally.

Once the bracket is properly positioned over the face plate, the face plate itself stops the bracket from twisting and the four corner members 34, as well as the wall 34*a* of the bracket, fit flushly against the wall supporting the face plate.

After the bracket has been properly positioned as described above, over the face plate, the plug lock is adjusted or set to the plug receptacle insertion position, is fitted into one of the plug receptacles leaving the other receptacle exposed. The plug lock is then adjusted to the receptacle locked in position, to prevent separation of the bracket mount from the receptacle. The plate portion 37 of the bracket mount overlaps the back surface of the wall 23 of the bracket trapping the bracket between the building wall and the bracket mount.

It is the bracket mount which prevents the bracket from releasing in a horizontal direction from the wall and it is the face plate secured to the outlet in the wall which prevents the bracket from moving in a vertical direction. This is well seen in FIG. 15 of the drawings. It is therefore, the actual wall itself which supports the load of the heater fan once it is hanging from the bracket.

Once the bracket has been mounted to the wall, it is a very simple matter to plug the heater fan in at the remaining exposed plug receptacle and to then hang the heater fan from the bracket as shown in FIG. 16 of the drawings. By tipping the heater fan, the hook 17 at the upper side of recess 15 on the back of the heater fan can be fitted over the hook 31 on bracket 21. The heater fan is then simply allowed to drop down to its normal upright positioning whereby the lower sloped wall 19 of the heater fan recess 15 locates beneath the radiused lower surface 32*a* on the webs 32 of the bracket. There is a slight gap between the web under surface 32*a* of the bracket and the bottom wall 19 of the fan recess which allows the fan to effectively float on the rubber bumpers 33 of the hook 31 of the bracket hanger. This insulated hanging, as well as the fitting of the rubber bumpers 30 on the bracket against the back surface of the heater fan, provides an extremely effective vibration dampener during operation of the heater fan.

The description above refers to the fact that the face plate over the electrical outlet can be set in either a vertical or horizontal orientation. When the face plate is in the horizontal position and as earlier described, the two plug receptacles will be located within opening portion 27*b* of the cross shaped opening in the bracket. The bracket mount will then be used in a position where the main body portion of the bracket mount is turned 90° from the FIG. 3 position. Therefore, the bracket and bracket mount can accommodate both orientations of the face plate without having to change the orientation of the bracket.

Figure 3A:
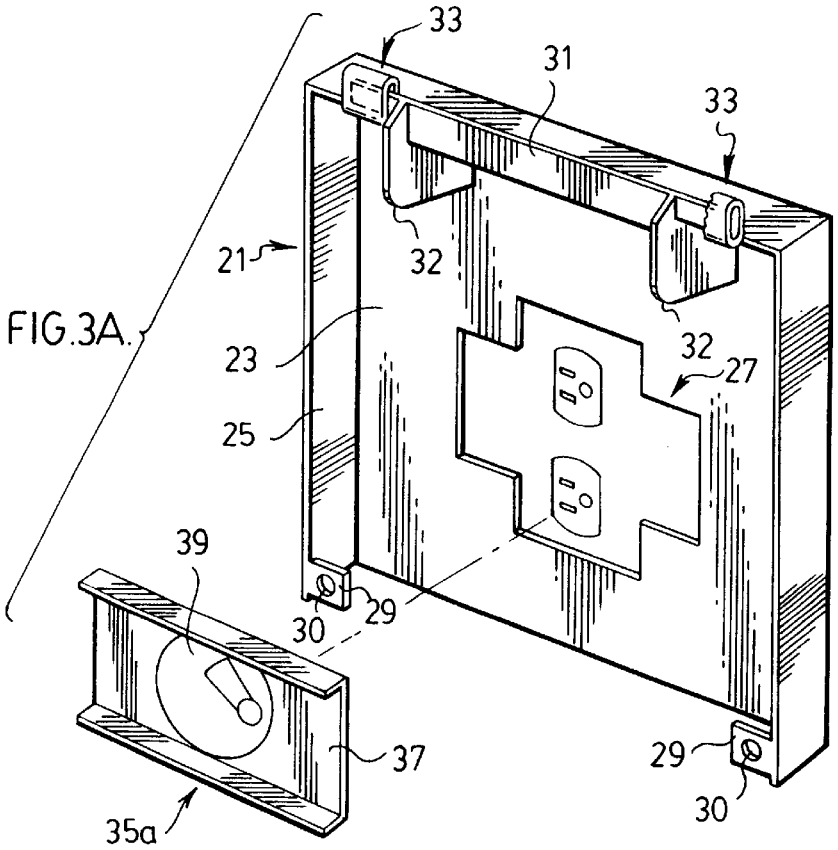
FIG. 3*a* is an exploded perspective view showing the same bracket as found in FIG. 3 with a slightly modified bracket mount for an electrical outlet different from that found in FIG. 3.

FIG. 3*a* shows an arrangement in which the face plate over a plug receptacle extends in a vertical direction but the plug receptacles themselves are turned at 90° from the direction that they are set in FIG. 3. This orientation of the plug receptacles is easily accommodated according to the present invention by simply installing the plug lock into the main body portion 37 of the bracket mount in the FIG. 11 position rather than the FIG. 10 position. In comparing the two figures, it will seen that in FIG. 11, housing 75 carrying the operating member 61 is turned at 90° from the FIG. 10 position. The positioning of the prongs and the post on the plug lock when the bracket mount is set up as shown in FIG. 11, can be seen in FIG. 14 of the drawings. This produces a bracket mount 35*a* which only differs from bracket mount 35 with respect to the orientation of the plug lock. The actual components used to make bracket mounts 35 and 35*a* are identical.

As will be understood from the above, the entire assembly, regardless of the direction of the face plate over the receptacle, and regardless of the orientation of the plug receptacles within the face plate, is set up without requiring the need for any tools whatsoever. The amount of support provided by the bracket is substantially more than the holding force provided by a convention plug on the back of a currently in use heater fan and is more than sufficient to support the weight of a substantially larger wall mounted heater fan than has been usable in the past. Accordingly, this system is capable of supporting the load of larger heating components to make the heater fan capable of operating at up to 1500 watts of power.

A conventional electrical outlet is designed to accept a maximum load of about 1500 watts. Therefore, the plug lock of the bracket mount, in effect, provides a safety feature because the plug lock acts as a block at one of the receptacles while the other plug receptacle feeds power to the heater fan.

Although the description above relates specifically to a heater fan, it will be appreciated that the mounting system can be used for various other different types of small electrical appliances to be suspended from a wall. The wall mounting system in the present invention thereby eliminates the need for floor space and in the case of the heater fan, raises the heater fan to the point where the air flow is desirably up off of the floor in the building.

Again, in accordance with the present invention, the plug lock, using a combination of prongs with a cam operated grounding post, can easily be adapted into a standard electrical plug where the prongs are conductive elements to produce a live locking plug.

Although various preferred embodiments of the present invention have been described herein in detail, it will be skilled in the art, that variations may be made thereto without departing from the spirit of the invention or the scope of the appended claims.

What is claimed is:

1. An assembly comprising a small electrical appliance having an electrical cord with an electrical plug, an appliance receiving bracket for suspending the appliance from a building wall and a bracket mount having a plug lock which is releasably lockable within one of a pair of plug receptacles of a standard wall outlet while leaving the other plug receptacle exposed to receive the electrical plug of the appliance, said plug lock comprising flat slot fitting prongs and an electrically insulated ground opening fitting post arranged with said prongs in a triangular pattern, said post having a longitudinal axis about which post is adjustable between a receptacle insertion position and a receptacle locked in position by a control member rotatably supported by said bracket mount, the appliance being separable from the bracket to plug in the appliance through the bracket after mounting the bracket and to then fit the appliance to the bracket hiding the electrical plug and cord of the appliance between the appliance and the bracket.

2. An assembly as claimed in claim 1, wherein said bracket has an upper end hook and wherein said appliance has a rear surface hook receptacle in which said hook of said bracket is releasably lockable.

3. An assembly as claimed in claim 1, wherein said electrical plug of said appliance has a flat profile to enable use of a small clearance space between said appliance and said bracket for hiding said electrical plug therein.

4. An assembly as claimed in claim 1, including vibration insulating material between said appliance and said bracket.

5. An assembly as claimed in claim 1, wherein said electrical cord of said appliance is shorter than a conventional appliance electrical cord.

6. An assembly as claimed in claim 1, wherein said appliance comprises a heater fan.

7. An assembly as claimed in claim 6, wherein said heater fan operates at up to 1500 watts.

8. A plug locking member comprising an insulated body having an interior side with a pair of spaced apart prongs and a post extending from said interior side, and an exterior side of said insulated body which is provided with a rotatable control member which upon rotation thereof moves said post between a first and a second position, the first position being one which enables insertion and the second position being one which locks said prongs and post into prong receiving slots and a ground opening of a standard wall fitted electrical receptacle.

9. A plug locking member as claimed in claim 8, wherein said control member products orbital movement of said post between said first and second positions.

10. A plug locking member as claimed in claim 8, wherein said control member comprises a lever at a generally right angle to said post.

11. A plug locking member as claimed in claim 8, wherein said post is made from an electrically non-conductive material.

12. A mounting assembly for suspending a small electrical appliance from a building wall, said assembly comprising an appliance receiving bracket and a bracket mount, said bracket mount comprising a plug lock consisting of an insulated body having an interior side with a pair of spaced apart prongs and a post extending from said interior side, and an exterior side of said insulated body which is provided with a rotatable control member which upon rotation thereof orbits said post between a first and a second position, the first position being one which enables and the second position being one which locks said prongs and said post into prong receiving slots and a ground opening of a standard electrical wall receptacle.

13. A mounting assembly as claimed in claim 12, wherein said bracket has a receptacle exposing opening therethrough and wherein said body portion of said bracket mount grips against one side of said bracket and said prongs and said post extend through said opening to the other side of said bracket.

14. A mounting assembly as claimed in claim 13, wherein said receptacle exposing opening through said bracket is in the shape of a cross.

15. A mounting assembly as claimed in claim 12, wherein said bracket is provided with an appliance receiving hanger.

16. A mounting assembly as claimed in claim 15, including appliance vibration dampeners on said bracket.

* * * * *